United States Patent [19]

Kandou et al.

[11] 4,136,626

[45] Jan. 30, 1979

[54] PRESSER FOOT

[75] Inventors: Akiyoshi Kandou, Uozu; Kiyoo Yoneya, Kurobe, both of Japan

[73] Assignee: Yoshida Kogyo K K, Chiyoda, Japan

[21] Appl. No.: 808,526

[22] Filed: Jun. 21, 1977

[30] Foreign Application Priority Data

Jun. 22, 1976 [JP] Japan ..... 51-81697[U]

[51] Int. Cl.[2] ..... D05B 29/00

[52] U.S. Cl. ..... 112/235

[58] Field of Search ..... 112/235, 236, 237, 240

[56] References Cited

U.S. PATENT DOCUMENTS

| | | | |
|---|---|---|---|
| 3,716,008 | 2/1973 | Howell | 112/240 |
| 3,854,433 | 12/1974 | Hanyu | 112/235 |
| 3,993,009 | 11/1976 | Osaki | 112/235 |

*Primary Examiner*—George H. Krizmanich

*Attorney, Agent, or Firm*—Bucknam and Archer

[57] ABSTRACT

A sewing machine presser foot includes a pin member pivotally supported in a pair of spaced lugs mounted on a sole member. The pin member has a strip between its journal ends, the strip extending through a groove provided through a stem member to be installed on a sewing machine bar. The groove has a cross-section of an ellipse having a pair of opposed walls across which the minor axis extends. The pin member is normally movable axiswise for its positional adjustment relative to the stem member. Upon pivotal movement of the pin member about its axis, edges of the strip come into frictional engagement with the walls of the groove, to thereby arrest axial movement of the pin member relative to the stem member. A slot is provided in the stem member, the slot being coextensive in length and communicating with the groove for the passage therethrough of the strip. One of the journal ends of the pin member has a knob or lever for rotation thereof.

6 Claims, 9 Drawing Figures

PRESSER FOOT

BACKGROUND OF THE INVENTION

1. Field of the Invention

The present invention relates to a presser foot for use in a sewing machine.

2. Prior Art

To bring a sewing needle into registry with a needle clearance aperture in a presser foot sole member against misalignment due primarily to machining tolerances of sewing machine parts, it is known to make the sole member laterally adjustable in position with respect to a presser foot stem member attached to a presser foot bar extending downwardly from a sewing machine head. A prior adjustable mechanism on the presser foot includes a groove provided in a stem member or a sole member and a strip fixed to the sole member or the stem member, the strip being slidably fitted in the groove for longitudinal adjusting movement.

With the known proposal, however, the sole member is subjected to accidental displacement relative to the stem member when a garment being sewn varies in thickness or changes its direction of feed while being progressively advanced during the sewing operation, or when a sewing thread is held under tension against the sole member upon removal of the garment after the sewing operation. This has frequently resulted in a curved line of stitches, a breakage of the sewing threads or a broken needle. One attempt to prevent the unwanted displacement of the sole member would be to increase a coefficient of friction of the strip in the groove. However, this would make the adjusting movement of the sole member rather sluggish, resulting in a difficulty in fine adjustment.

SUMMARY OF THE INVENTION

According to the present invention, a presser foot sole member has a pin member extending laterally between and supported at the ends in a pair of spaced upstanding lugs of the sole member, the pin member having an intermediate strip and being pivotable about its own central axis. A presser foot stem member has a transverse through groove and a slot coextensive in length and communicating with the groove. The strip of the pin member enters through the slot into the groove and is freely movable lengthwise in the groove for positional adjustment of the sole member relative to the stem member. The wall defining the groove has a portion with which an edge of the strip of the pin can engage upon pivotal movement of the latter to thereby arrest accidental lateral displacement of the sole member during the sewing operation.

It is an object of the present invention to provide a presser foot having a sole member that can be easily adjusted and fixed in position with respect to a stem member.

Another object of the present invention is to provide a presser foot having a sole member which can be attached to a stem member in a simple operation.

These and other objects will become more apparent from the following description taken in conjunction with the accompanying drawings.

DETAILED DESCRIPTION OF THE PREFERRED EMBODIMENTS

Figure 1:
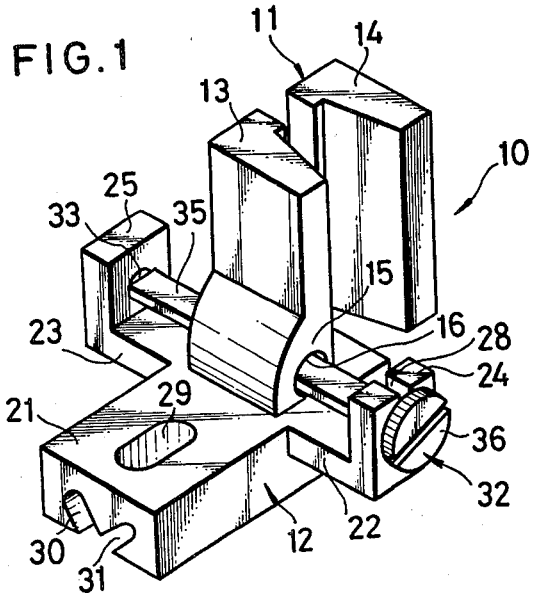
FIG. 1 is a perspective view of a presser foot constructed in accordance with an embodiment of the present invention.
Figure 2:
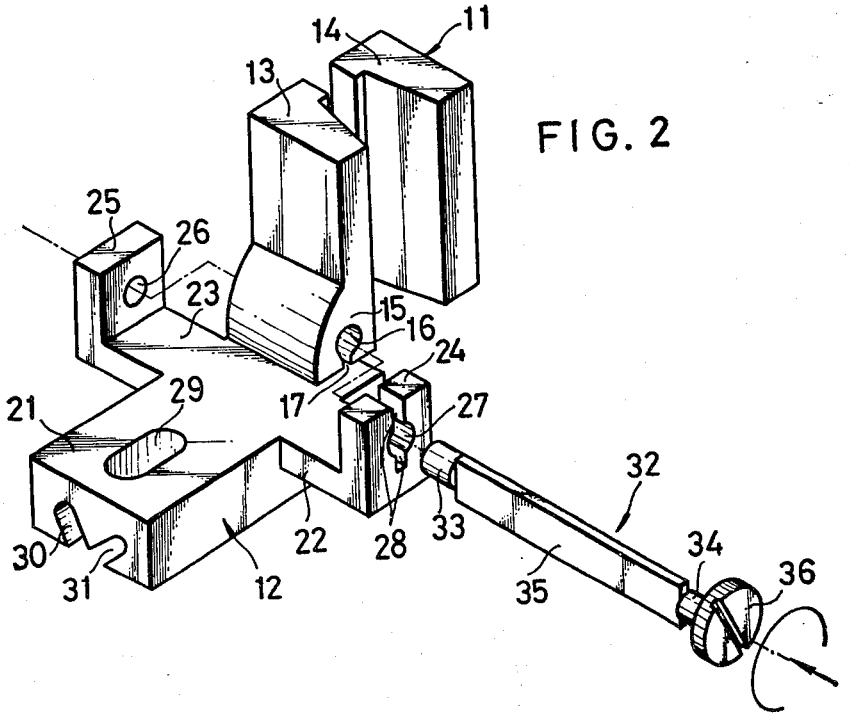
FIG. 2 is an exploded perspective view of the presser foot shown in FIG. 1.

In FIGS. 1 and 2, a presser foot generally indicated by 10 comprises a vertical stem member 11 for attachment to a presser foot bar (not shown) extending downwardly from a sewing machine head, and a horizontal sole member 12 pivotally mounted on the stem member 11.

Figure 3:
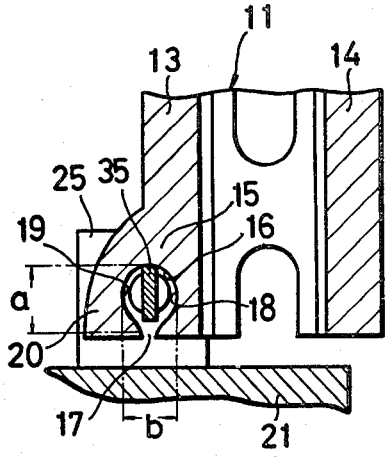
FIG. 3 is a vertical cross-sectional view of the presser foot right after it is assembled.

The stem member 11 includes a pair of front and rear legs 13,14. The front leg 13 has a bulged portion 15 at its lower end, the bulged portion 15 projecting forwardly. A horizontal groove 16 is provided in the bulged portion 15 and extends therethrough transversly of a direction in which a garment being sewn is progressively fed under the presser foot 10. A slot 17 is defined beneath the groove 16 so as to be coextensive in length with the groove 16. The slot 17 communicates between the groove 16 and a bottom face of the front leg 13, so that the goove 16 opens downwardly. As shown in FIG. 3, the groove 16 is generally an ellipse in cross-section having a vertical major axis a longer than a horizontal minor axis b. The goove 16 is defined partly by a pair of opposed wall portions 18,19 across which the horizontal minor axis b extends. With the groove 16 and slot 17, the bulged portion 15 is provided with a resilient grip arm 20 having a tendency to spring back when forced away from the wall portion 18 of the groove 16.

The sole member 12 has a sole body 21 and a pair of arms 22,23 extending laterally from the sole body 21 away from each other. The arms 22,23 include a pair of spaced upstanding lugs 24.25, respectively, the lugs 24,25 being spaced apart a distance larger than a width of the front leg 13 of the stem member 11. The lug 25 has a central hole 26, and the lug 24 has a central hole 27 and a vertical slot 28 extending all the way from the top of the lug 24 through the hole 27 down to a level lying substantially flush with the top surface of the arm 22. The hole 26 in the lug 25 is held in registry with the hole 27 in the lug 24. The holes 26,27 are circular in cross-section.

A needle clearance aperture 29 is defined in the sole body 21 and located near its front end. Provided in the bottom of the sole body 21 are a pair of guide channels 30,31 for the reception of a pair of rows of elements (not shown) of a concealed sliding clasp fastener to be sewn onto a garment.

A pin member 32 comprises a pair of journal ends 33,34 and a strip 35 integral with and extending between the journal ends 33,34. The journal ends 33,34 are cross-sectionally circular and are pivotally supported in the holes 26,27 in the lugs 25,24, respectively. The strip 35 has a thickness smaller than the spacing of both the slots 17 and 28.

A width of the strip 35 is larger than the horizontal minor axis b of the groove 16 that is oval in cross-section. A knob 36 is coaxially attached to the journal end 34 for the rotation of the pin member 32 about its axis.

To assemble the presser foot 10, the pin member 32 is inserted into the hole 27 with the strip 35 held vertically so as to pass through the slot 28, as shown in FIG. 2. The pin member 32 is then axially pushed until the journal end 33 is received in the hole 26 and the journal end 34 is received in the hole 27, whereupon the pin member 32 is installed on the sole member 12. Then, the vertically oriented strip 35 is passed through the slot 17 into the groove 16 in the front leg 13 of the stem member 11. The strip 35 is fully accommodated in the groove, as shown in FIG. 3. At this time, since the strip 35 is free from forced engagement with a groove-bounding wall, the strip 35 is axially movable in the groove 16. The sole member 12 is laterally shifted into a position wherein the aperture 29 is held in registry with the sewing machine needle.

Figure 4:
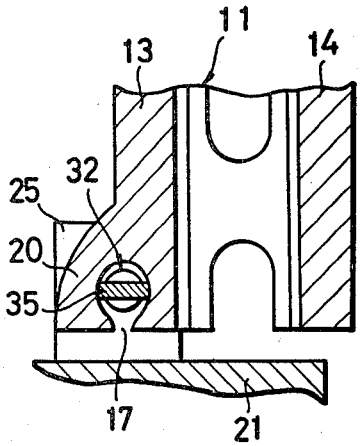
FIG. 4 is a view similar to FIG. 3 but showing the parts when the sole member is fixed relatively to the stem member.

After the positional adjustment of the sole member 12 has been completed, the pin member 32 is pivoted about its axis approximately through 90 degrees until the opposed edges of the strip 35 are forced into frictional engagement with the walls 18,19 (FIG. 4). The grip arm 20 is then caused to be deflected away from the wall 18. Since the grip arm 20 is resilient, it tends to spring back, thereby holding the strip 35 tightly between the opposed walls 18,19.

Accordingly, the strip 35 and hence the sole member 12 are prevented positively from axial displacement relative to the stem member 11.

Preferably, the stem member 11 is made of plastic material to provide the grip arm 20 with a desired degree of resiliency. The pin member 32 is preferably made of metal to increase regidity and reduce a twist which would be produced therein when subjected to torsional forces during its rotation.

An advantage accruing from the presser foot 10 thus constructed is that the sole member 12 can be adjusted in position with a minimum amount of force, and can be fixed relatively to the stem member 11 with ease. Once fixed, the sole member 12 is prevented from being accidentally shifted out of position during the sewing operation.

According to another embodiment illustrated in FIGS. 5 through 9, a front leg 40 of a stem member 41 has a groove 42 of a generally elliptical cross-section (FIGS. 6 and 7), through which a strip 43 of a pin member 44 extends. A pair of opposed walls 45,46 that partly define the groove 42 act as surfaces with which the strip 43 is engageable. A pair of diametrically opposed ridges 47,48 extend into the groove 42 and are located beneath the wall 45 and above the wall 46, respectively. A slot 49 communicates between the groove 42 and a bottom face of the front leg 40 of the stem member 41. Defined upwardly of the groove 42 is a recess 50 that makes a grip arm 51 more springy, especially where the stem member is made of metal.

Figure 5:
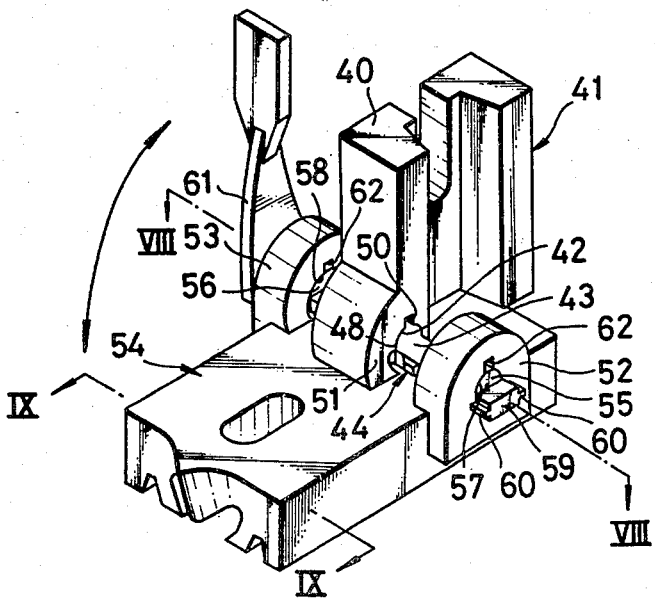
FIG. 5 is a perspective view of a presser foot according to another embodiment.
Figure 9:
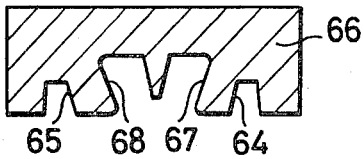
FIG. 9 is a vertical cross-sectional view taken along line IX—IX of FIG. 5.

As shown in FIG. 5, the pin member 44 is pivotally supported in a pair of opposed upstanding lugs 52,53 mounted on a sole member 54. The pin member 44 has a pair of spaced journals 55,56 disposed in a pair of holes 57,58 provided in the lugs 52,53, respectively. An end plate 59 is integrally formed with the journal 55, the end plate 59 extending substantially in parallel with the strip 43. The end plate 59 has a length equal to the diameter of the journal 55. The end plate 59 has a pair of retainer projections 60 integral therewith and extending away from each other. A lever 61 is secured to the journal 56 for the pivotal movement of the pin member 44 about its axis. A pair of upper and lower recesses 62 (only the upper recess shown) is provided in each lug, the recesses 62 communicating with the holes 57,58. When the pin member 44 is inserted into the holes 57,58 for installation on the sole member 54, the retainer projections 60 pass through the upper and lower recesses 62 in each lug.

Figure 8:
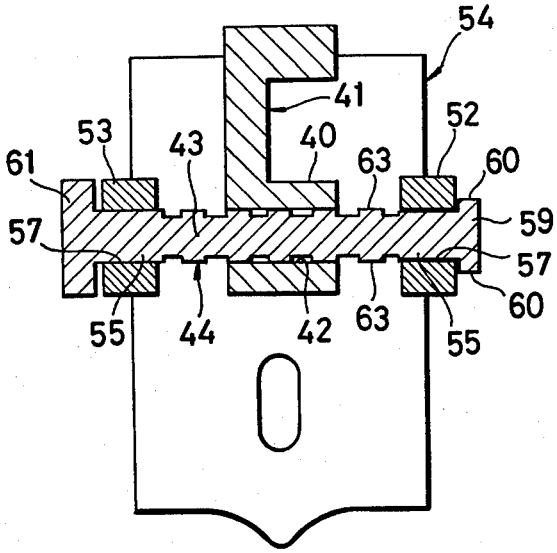
FIG. 8 is a horizontal cross-sectional view taken along line VIII—VIII of FIG. 5.

As best illustrated in FIG. 8, a plurality of teeth 63 are provided on each of the opposed edges of the strip 43, the teeth 63 being spaced along the length of the strip 43. Upon pivotal movement of the pin member 44 about its axis, the teeth 63 can be held in uniform engagement with portions of the opposed walls 45,46, which portions are located along the length of the walls 45,46.

The grooves 64,65 facilitate removal of the sole body 66 from molds (not shown) after sole body molding operation.

Figure 6:
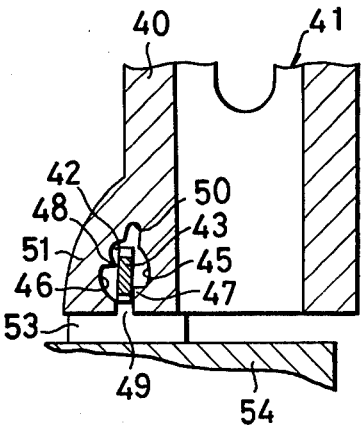
FIG. 6 is a vertical cross-sectional view of the modified presser foot with its sole member ready for being fixed relatively to the stem member.
Figure 7:
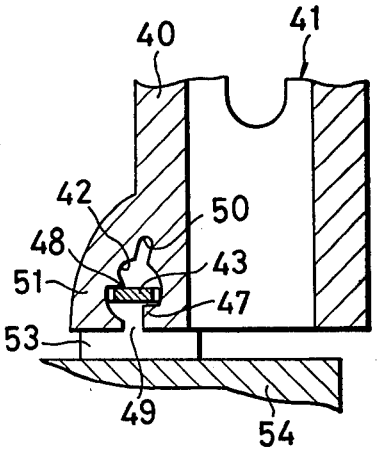
FIG. 7 is a view similar to FIG. 6 but showing the presser foot when the sole member is locked with respect to the stem member.

After installation on and positional adjustment relative to the stem member 41, the sole member 54 is fixed thereto by lifting the lever 61 to the upstanding position as shown in FIG. 5, whereupon the strip 43 is turned about its axis from the position of FIG. 6 to that shown in FIG. 7. As the strip 43 is pivoted, the teeth 63 on the strip 43 come into frictional engagement with the walls 45,46, and force the grip arm 51 against its resiliency away from the wall 45. Further rotation of the pin member 44 is prevented by the ridges 47,48 projecting in the way. Thus, the ridges 47,48 serve as a stop without which the operator might inadvertently give the pin member strip 43 a full revolution in the groove 42. The retainer projections 60, when pivoted out of alignment with the upper and lower recesses 62,62 in the lug 52, prevent the pin member 44 from being pulled out. Accordingly, the pin member 44 is retained against removal once the lever 61 is pivoted upwardly for fixation of the sole member 54 with respect to the stem member 41.

Although the presently preferred embodiments of this invention have been described, it will be understood that various changes may be made without departing from the scope of the appended claims. For example, the groove 16(42) may be of other cross-sectional shapes than the ellipse provided that the strip 35(43) can be engaged by groove-grounding walls upon pivotal movement of the pin member 32,44 about its axis through a predetermined angle.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A presser foot for a sewing machine comprising:

a stem member for attachment to a sewing machine bar, said stem member having a groove defined therein partly by a wall;

a sole member including a pair of spaced lugs having a pair of holes therein, respectively; and a pin member having a pair of spaced journals and a strip provided therebetween, said journals being pivotally supported in said holes, said strip extending through said groove, and said strip having an edge forcibly engageable with said wall upon pivotal movement of said pin member about its axis through an angle, to thereby retain said pin member against axial displacement relative to said stem member.

2. A presser foot according to claim 1, said groove being an ellipse in cross-section having a pair of opposed walls, said strip having a pair of opposed edges engageable with said opposed walls upon pivotal movement of said pin member about its axis.

3. A presser foot according to claim 2, comprising a pair of diametrically opposed ridges extending into said grooves, one of said grooves being provided above one of said walls and the other groove beneath the other wall.

4. A presser foot according to claim 1, said stem member having a slot coextensive in length and communicating with said groove, said strip having a thickness smaller than a spacing of said slot for the passage therethrough.

5. A presser foot according to claim 1, comprising a knob coaxially mounted on one of said journals.

6. A presser foot according to claim 1, comprising a lever mounted on one of said journals and a pair of retainer projections integral with the other journal.

* * * * *